US005709989A

United States Patent [19]

Mehta et al.

[11] Patent Number: 5,709,989

[45] Date of Patent: Jan. 20, 1998

[54] PROCESS FOR MAKING HIGH CHLORIDE TABULAR GRAIN EMULSION USING MULTIPLE STREAM ADDITION OF IODIDE

[75] Inventors: Rajesh Vinodrai Mehta; Donald Robert Irwin; Douglas E. Singer, all of Rochester, N.Y.

[73] Assignee: Eastman Kodak Company, Rochester, N.Y.

[21] Appl. No.: 708,154

[22] Filed: Aug. 27, 1996

[51] Int. Cl.[6] ..... G03C 1/015; G03C 1/035

[52] U.S. Cl. ..... 430/569; 430/567

[58] Field of Search ..... 430/569, 567

[56] References Cited

U.S. PATENT DOCUMENTS

| | | | |
|---|---|---|---|
| 3,650,757 | 3/1972 | Irie et al. | 430/569 |
| 5,320,938 | 6/1994 | House et al. | 430/567 |
| 5,413,904 | 5/1995 | Chang et al. | 430/569 |
| 5,424,180 | 6/1995 | Saitou | 430/569 |

*Primary Examiner*—Mark F. Huff

*Attorney, Agent, or Firm*—Paul A. Leipold

[57] ABSTRACT

The invention generally relates to a process for forming tabular silver chloride grains comprising nucleating silver chloride particles, introducing alkali iodide solution into the dispersing medium containing the nucleated silver chloride particles, and introducing silver ion and chloride ion solutions into said dispersing medium, with the proviso that introduction of the alkali iodide is by multiple streams of said alkali iodide at a momentum range of up to $1\times10^{+9}$ g cm/s$^2$.

20 Claims, 3 Drawing Sheets

PROCESS FOR MAKING HIGH CHLORIDE TABULAR GRAIN EMULSION USING MULTIPLE STREAM ADDITION OF IODIDE

FIELD OF THE INVENTION

This invention relates to the formation of silver halide emulsions. It particularly relates to processes for the formation of tabular silver chloride emulsions.

BACKGROUND OF THE INVENTION

In the formation of silver halide emulsions there are various techniques for addition of the silver solution and halogen solution to the reactor vessel. These materials typically are introduced from pipes under the surface of the liquid in the reactor vessel. It has been known to introduce such materials from perforated pipes above the surface of the reactor vessel in the formation of emulsions of grains that are non-tabular. It has been known to control the flow of materials through the perforated pipes by changing the nozzle size of the holes in the pipe. The addition of a reagent using the perforated pipe is carried out by gravity flow from a supply vessel to the perforated pipe.

House et al, U.S. Pat. No. 5,320,938, titled 'High Chloride Tabular Grain Emulsions and Processes for Their Preparation' disclose a process for the preparation of high chloride {100} tabular grain emulsions that relies upon the presence of iodide ions at the grain nucleation site. Chang et al, U.S. Pat. No. 5,413,904, titled 'High Chloride {100} Tabular Grain Emulsions Improved Emulsions and Improved Precipitation Processes' disclose an improved preparation of high chloride {100} tabular grain emulsion that relies on delaying the iodide ion introduction until after the grain nucleation proportion of the preparation is completed. Both the prior art processes use chemical means, such as the concentration of iodide ions, to adjust the size of the tabular crystals.

PROBLEM TO BE SOLVED BY THE INVENTION

There remains a need to improve the control of particle size in the formation Of tabular silver halide emulsions. There is a particular need for processes that may be reliably reproduced for different size batches of tabular silver chloride emulsions of the same formula.

SUMMARY OF THE INVENTION

An object of the invention is to provide improved tabular silver chloride emulsions.

A further object is to provide better control of processes for forming tabular silver chloride emulsions.

These and other objects of the invention are generally accomplished by a process for forming tabular silver chloride grains comprising nucleating silver chloride particles, introducing alkali iodide solution into the dispersing medium containing the nucleated silver chloride particles, and introducing silver ion and chloride ion solutions into said dispersing medium, with the proviso that introduction of the alkali iodide is by multiple streams of said alkali iodide at a momentum range of up to $1\times10^{+9}$ g cm/s$^2$.

ADVANTAGEOUS EFFECT OF THE INVENTION

The invention provides improved control of the formation of tabular silver chloride emulsions. It particularly provides improved control of the addition of the iodide ion so as to control the particle size of the tabular silver chloride grains in an exact and reproducible manner. The invention also provides reliable scaleability of batch sizes in the preparation of tabular silver chloride grains.

DETAILED DESCRIPTION OF THE INVENTION

The invention has numerous advantages over the prior techniques for forming tabular silver chloride grains. The invention is about non-chemical means to achieve variation in the size of the tabular silver chloride emulsion. It thus allows the use of a common set of chemical solutions to prepare a broad range of tabular grain emulsions, which is advantageous in a manufacturing environment. It is also attractive for the scale-up purposes as it minimizes the experimentation that is usually necessary when chemical means are used to adjust the size. The invention also allows the easy transfer of manufacturing processes from one facility to another as the easily controlled technique of the invention allows accurate reproducibility of processes in different manufacturing environments. It is surprising that the momentum of addition of material has been found to be important in determining grain size as in previous processes this was not recognized. Previously time of addition was considered a critical parameter as well as process conditions such as temperature, solubility, pH and peptizer level.

The present invention relates to a process for precipitating high chloride tabular emulsions. Also disclosed are apparatus for precipitating high chloride tabular emulsions. While experimenting with the processes for manufacturing tabular silver chloride such as the process taught by Chang et. al. to enhance manufacturability, we have discovered that by modulating certain fluid dynamic properties of the iodide ion feed stream as it is added into the dispersing medium, it is possible to correspondingly vary the size of the tabular grain emulsion. In particular, the fluid dynamic properties of interest are the momentum (i.e., mass flow rate×velocity) and the characteristic length scale of the iodide feed stream (i.e., diameter).

We have discovered that the fluid dynamic properties can be easily modulated by passing the iodide ion feed stream through a Momentum Distribution Device (MDD). The device essentially splits the single feed stream into a multiple of nominally identical streams, each having a certain desired momentum, and a desired characteristic length scale. The multiple streams are then added to the reactor. These and other advantages of the invention will be apparent from the discussion below.

Figure 2:
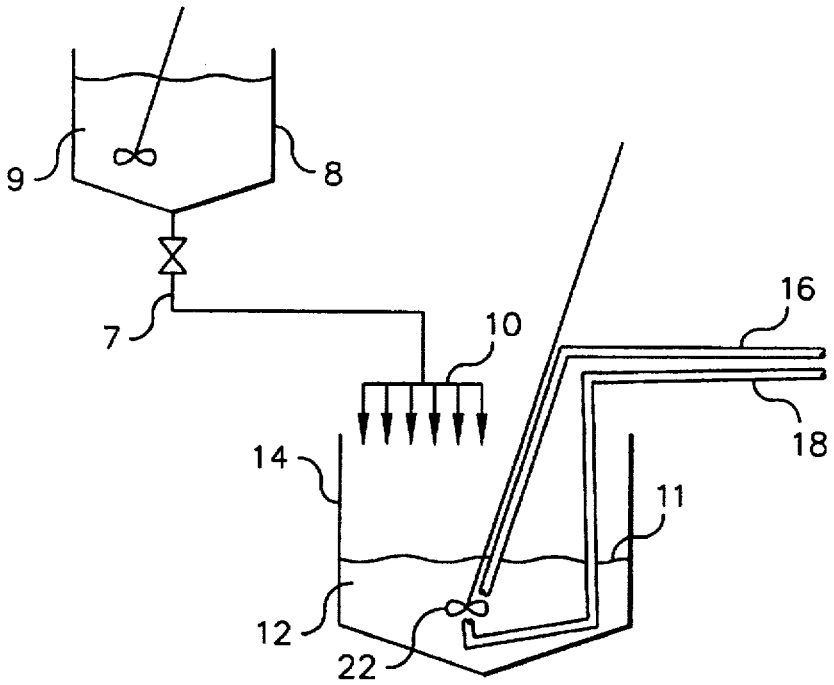
FIG. 2 is a schematic representation of the apparatus utilized in the process of the invention.

FIG. 2 is the schematic process diagram of the invention where the outlet 7 of the vessel 8 containing the iodide ion solution 9 is connected to a momentum distribution device 10 that opens above the surface 11 of the stirred dispersing medium 12. In performing the process of the invention, nucleation is accomplished in vessel 14 by introduction of silver ion solution through device 16 while chloride ion is introduced through device 18 in the close vicinity of stirrer 22. After nucleation of the silver chloride particles, iodide ion is added from momentum distribution device 10. After the addition of the iodide there is a hold without addition of reactants to allow the completion of interaction between the nucleated silver chloride particles and iodide ions. After the hold, further silver ion is added through device 16 and further chloride through device 18 to grow the tabular silver chloride grains to the desired size. After growth of the grains has been completed, the emulsion is washed to remove excess salts and liquid by conventional means not shown.

Figure 3:
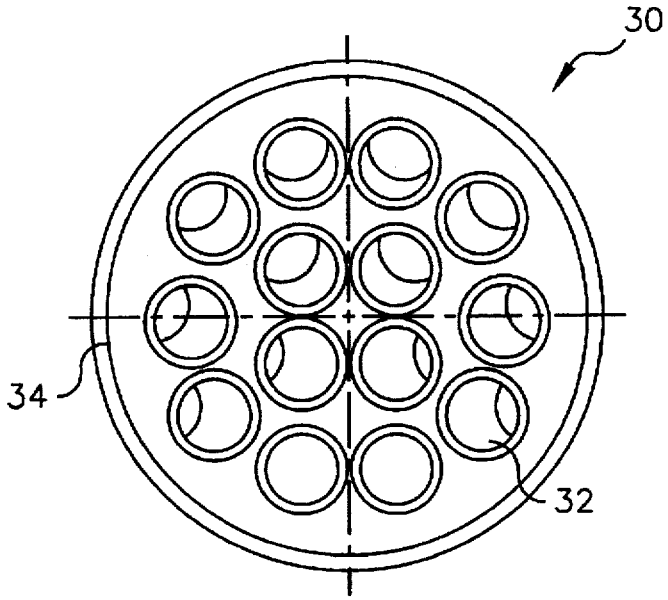
FIG. 3, 4, and 5 are the top, front, and bottom view of a planar foraminous distribution device utilized in the invention.
Figure 4:
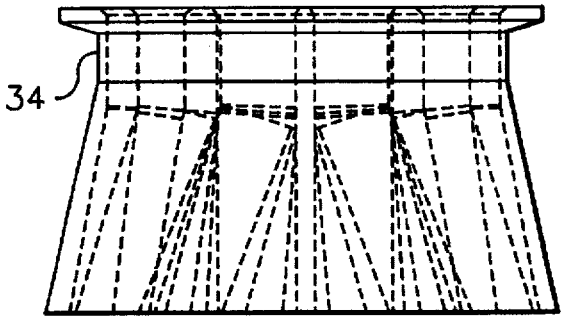
Figure 5:
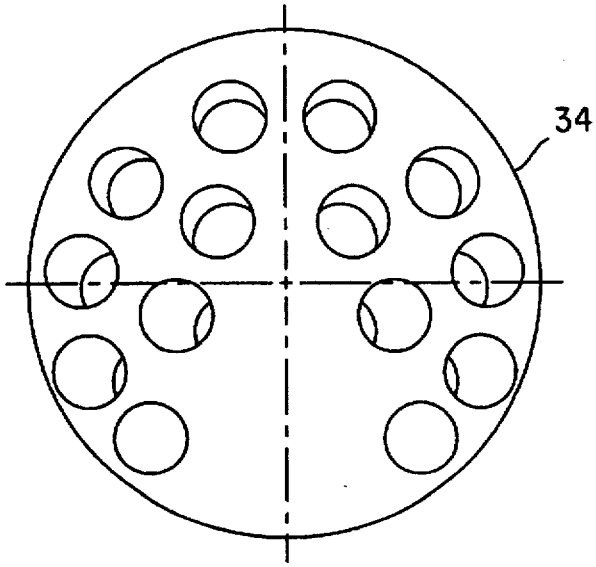

FIGS. 3, 4, and 5 are the top, front, and bottom views, respectively, of one of the preferred designs of the momentum distribution device 30. A multiple of cylindrical bores 32 are made in a cylindrical body 34. Each bore has a unique orientation. As may be appreciated from FIG. 5 which is the bottom view of device 30, the streams exit the bores 32 in a diverging pattern.

Figure 6:
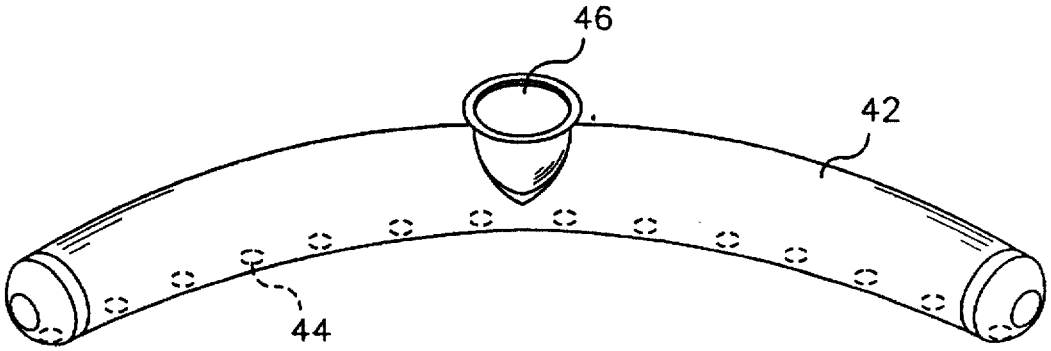
FIG. 6 illustrates a perforated pipe distribution device utilized in the invention.

FIG. 6 is another preferred embodiment of the momentum distribution device of the invention. A single channel or pipe 42 has multiple perforations 44 that are appropriately separated from each other. Iodide ion would enter inlet 46 and be distributed to exit pipe 42 through holes 44.

Figure 7:
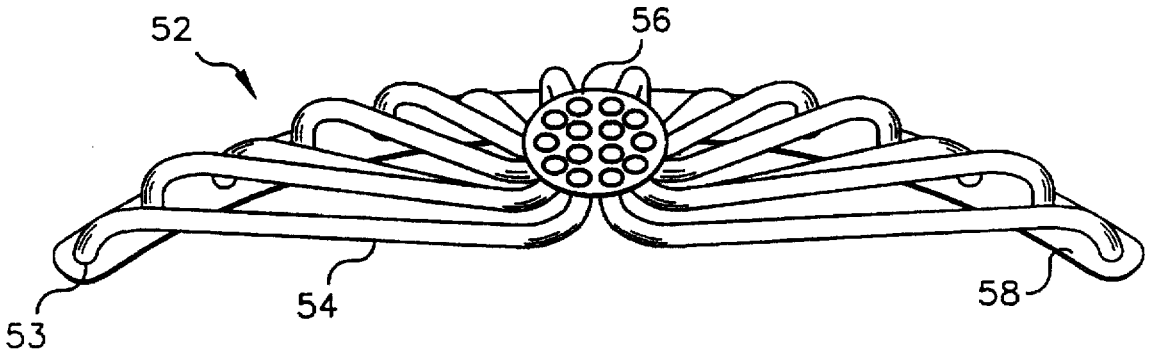
FIG. 7 is a manifold type distribution device utilized in the invention.

FIG. 7 is another preferred embodiment 52 of the invention. A multiple of nominally identical perforations 53 are made in a circular disc 58. Each of the perforations is then connected to a separate pipe or channel 54 that is positioned above the surface of the dispersing medium, and is separated appropriately from the other channels. Iodide ion solution enters at inlet 56 and passes through pipes 54 for distribution through perforations 53.

The momentum distribution device of the invention may be placed in any suitable location in the vessel in which the tabular silver chloride emulsion is being formed. The distribution device may be placed above the surface of the liquid in the reaction vessel such that the streams are directed onto the surface. Alternatively the distribution device may be submerged in the liquid in the reaction vessel. The momentum of the liquid being released from the device is controlled such that whether the device is above the surface of the liquid or below, the momentum of the liquid will be at the desired value when it reaches the reaction liquid in the vessel. Therefore, if delivery is from above the surface of the liquid in the vessel, the additional momentum created from the fall from the momentum distribution device to the dispersing medium must be calculated in order to determine the momentum at the moment contact is made with the dispersing medium. The momentum is defined as mass flow rate times average velocity of the stream and is defined in terms of gram centimeters per second squared (g $cm/s^2$).

The size of the holes in the distribution device may be any size that results in a suitable tabular silver chloride grain emulsion. Size of the hole is preferred to be between about 0.1 and about 70 mm as this size produces suitable control of the process and desirable tabular silver chloride emulsions. The number of holes through which silver iodide is added may suitably be between 2 and about 200 as this number of holes produces in combination with the preferred diameter the desired range of momenta which results in suitable tabular silver chloride grain emulsion across a practical range of iodide solution mass delivery rates.

The momentum of each of the iodide ion streams is any amount that will produce suitable tabular silver chloride grains. Preferably this is between about $1\times10^{-6}$ and $1\times10^{+9}$ g $cm/s^2$ to produce suitable tabular silver chloride grain emulsions in a reproducible manner. The momentum may be varied for a given number and size of holes by changing the pressure of the iodide solution as it is supplied to the momentum distribution device. The momentum also may be varied by changing the number of holes for delivery or the size of the holes when a given pressure is utilized for the iodide ion solution delivery.

The process of the invention finds its preferred use in the process of U.S. Pat. No. 5,413,904 (Chang et al) hereby incorporated by reference. In one aspect the invention is directed to a process of precipitating a photographic emulsion containing grains comprised of iodide and at least 50 mole percent chloride with tabular grains having {100} major faces accounting for greater than 50 percent of total grain projected area, comprised of the steps of (1) separately introducing soluble silver and halide salts into a reaction vessel containing at least a portion of the dispersing medium so that nucleation occurs while the dispersing medium is maintained at a pCl in the range of from 0.5 to 3.5 and (2) following step (1) completing grain growth under conditions that maintain the (100) major faces of the tabular grains, wherein, (3) precipitation is conducted in the absence of an aromatic grain growth stabilizer containing a nitrogen atom having a resonance stabilized π electron pair and (4) during step (1) iodide ion is withheld from the reaction vessel until after the soluble silver and halide salts have reacted in the reaction vessel to form grain nuclei and thereafter introduced into the reaction vessel.

In another aspect this invention is directed to a radiation sensitive emulsion containing a silver halide grain population comprised of iodide and at least 50 mole percent chloride, wherein tabular grains having {100} major faces and an aspect ratio of at least 2 account for greater than 95 percent of total grain projected area.

DESCRIPTION OF PREFERRED EMBODIMENTS

As employed herein the term "high chloride {100} tabular grain" indicates a grain that contains at least 50 mole percent chloride, based on silver, that exhibits major faces lying in {100} crystal planes, exhibits an aspect ratio of at least 2 and a ratio of major face adjacent edge lengths of less than 10.

A "high chloride {100} tabular grain emulsion" is an emulsion in which greater than 50 percent of total grain projected area is accounted for by high chloride {100} tabular grains.

Aspect ratio is defined as ECD/t, where ECD is the equivalent circular diameter of a grain and t is its thickness. Average aspect ratio is the quotient average ECD and average grain thickness.

The term "oxidized gelatin" refers to gelatin that has been treated with an oxidizing agent to reduce methionine to less than 30 micromoles per gram.

The present invention is an improvement on the high chloride {100} tabular grain precipitation process disclosed by House et al, cited above and here incorporated by reference. Except as otherwise described the precipitation procedures and emulsions satisfying the requirements of this invention can take any of the forms described by House et al, the disclosure of which is here incorporated by reference.

Grain nucleation is undertaken by separately introducing soluble silver and halide salts into a reaction vessel containing at least a portion of the dispersing medium forming the final emulsion while the dispersing medium is maintained at a pCl in the range of from 0.5 to 3.5. Following grain nucleation grain growth is completed under conditions that maintain the {100} major faces of the tabular grains.

The inclusion of iodide into the cubic crystal lattice being formed by silver ions and the remaining halide ions is disruptive because of the much larger diameter of iodide ion as compared to chloride ion. The incorporated iodide ions introduce crystal irregularities. The present invention differs from House et al in withholding iodide ion until after grain nuclei formation has been initiated in the high chloride environment. This avoids the formation of unwanted grain shapes, such as singly twinned nontabular grains. After grain nuclei have been formed under conditions that favor the formation of cubic grains, the delayed introduction of iodide ion along with the silver and halide ions required for further grain growth results in the preexisting grain nuclei growing into tabular grains rather than regular (cubic) grains.

It is believed that the delayed incorporation of iodide ion into the crystal structure of preexisting cubic grain nuclei results in more growth accelerating irregularities in at least two adjacent cubic crystal faces. Unlike the emulsions of House et al, which contained a significant rod population, indicative of growth accelerating crystal face irregularities in only one or perhaps two opposed cubic crystal faces, the precipitation process of the present invention has been observed to produce emulsions nearly devoid of rods. This suggests that the delayed introduction of iodide ions is even more effective than having iodide ions present at the outset of the nucleation, as taught by House et al.

At the outset of precipitation a reaction vessel is provided containing a dispersing medium and conventional silver and reference electrodes for monitoring halide ion concentrations within the dispersing medium. Halide ion is introduced into the dispersing medium that is at least 50 mole percent chloride—i.e., at least half by number of the halide ions in the dispersing medium are chloride ions. The pCl of the dispersing medium is adjusted to favor the formation of {100} grain faces on nucleation—that is, within the range of from 0.5 to 3.5, preferably within the range of from 1.0 to 3.0 and, optimally, within the range of from 1.5 to 2.5.

The grain nucleation step is initiated when a silver jet is opened to introduce silver ion into the dispersing medium. Iodide ion is withheld from the dispersing medium until after the onset of grain nucleation. Preferably iodide ion introduction is delayed until at least 0.005 percent of total silver used to form the emulsion has been introduced into the dispersing medium. Preferred results (high chloride {100} tabular grain projected areas of greater than 95 percent in the completed emulsions) are realized when iodide ion introduction is initiated in the period ranging from 0.01 to 3 (optimally 1.5) percent of total silver is introduction.

Effective tabular grain formation can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", J. of Photog. Science, Vol. 10 (1962), pp. 129–134, to be 13 mole percent. In silver halide grains in which equal molar proportions of chloride and bromide ion are present up to 27 mole percent iodide, based on silver, can be incorporated in the grains. It is contemplated to undertake grain growth below the iodide saturation limit to avoid the precipitation of a separate silver iodide phase and thereby avoid creating an additional category of unwanted grains. It is generally preferred to maintain the iodide ion concentration after its delayed introduction into the dispersing medium at the outset of nucleation at less than 10 mole percent. In fact, only minute amounts of iodide are required to achieve the desired tabular grain population. Concentrations of iodide after its delayed introduction down to 0.001 mole percent, based on total silver, are contemplated. For convenience in replication of results, it is preferred to maintain the concentrations of iodide ion after its delayed introduction in the range of at least 0.005 mole percent and, optimally, at least 0.07 mole percent, based on total silver. The preferred delays of iodide ion introduction noted above are effective with minimum and near minimum iodide introduction levels. However, with further delays in iodide introduction that can range up to 40 percent or more of total silver introduction, compensating increases in iodide concentrations are contemplated.

In a preferred method silver chloride grain nuclei are formed at the outset of the nucleation step. Minor amounts of bromide ion can be present also in the dispersing medium at the outset of nucleation. Any amount of bromide ion can be present in the dispersing medium at the outset of nucleation and subsequently that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. Precipitation under the initial conditions in the reaction vessel, hereinafter referred to as Step (1) conditions, can be terminated at any time after the minimum iodide addition described above has been completed. Since silver iodide is much less soluble than silver chloride, any iodide ion introduced into the dispersing medium precipitates instantaneously. For manipulative convenience and reproducibility, silver ion introduction under Step (1) conditions is preferably extended for a convenient period, typically from 5 seconds to less than 2 minutes, and typically during this period from about 0.1 to 10 mole percent of total silver is introduced into the dispersing medium. So long as the pCl remains within the ranges set forth previously no additional chloride ion need be added to the dispersing medium during Step (1). It is, however, preferred to introduce both silver and halide salts concurrently during this step. The advantage of adding halide salts concurrently with silver salt throughout Step (1) is that the variation of pCl within the dispersing medium can be minimized or eliminated. Once sufficient iodide introduction has occurred to initiate tabular grain growth, further iodide introduction is not required to sustain tabular grain growth. Thus, subsequent iodide introduction in either or both of Step (1) or the subsequent growth step, hereinafter designated Step (2), is a matter of preference only based on well known photographic performance considerations.

Any convenient conventional choice of soluble silver and halide salts can be employed during the Step (1). Silver ion is preferably introduced as an aqueous silver salt solution, such as a silver nitrate solution. Halide ion is preferably introduced as alkali or alkaline earth halide, such as lithium, sodium, potassium and/or calcium chloride, bromide and/or iodide.

The dispersing medium contained in the reaction vessel prior to nucleation is comprised of water, the dissolved halide ions discussed previously and a peptizer. The dispersing medium can exhibit a pH within any convenient conventional range for silver halide precipitation, typically from 2 to 8. It is preferred, but not required, to maintain the pH of the dispersing medium on the acid side of neutrality (i.e., <7.0). To minimize fog a preferred pH range for precipitation is from 2.0 to 6.0. Mineral acids, such as nitric acid or hydrochloride acid, and bases, such as alkali hydroxides, can be used to adjust the pH of the dispersing medium. It is also possible to incorporate pH buffers.

The peptizer can take any convenient conventional form known to be useful in the precipitation of photographic silver halide emulsions and particularly tabular grain silver halide emulsions. A summary of conventional peptizers is provided in *Research Disclosure*, Vol. 308, December 1989, Item 308119, Section IX. *Research Disclosure* is published by Kenneth Mason Publications, Ltd., Emsworth, Hampshire P010 7DD, England. While synthetic polymeric peptizers of the type disclosed by Maskasky I, cited previously and here incorporated by reference, can be employed, it is preferred to employ gelatino peptizers (e.g., gelatin and gelatin derivatives). As manufactured and employed in photography gelatino peptizers typically contain significant concentrations of calcium ion, although the use of deionized gelatino peptizers is a known practice.

Step (1) can be performed at any convenient conventional temperature for the precipitation of silver halide emulsions. Temperatures ranging from near ambient—e.g., 30° C. up to about 90° C. are contemplated, with nucleation temperatures in the range of from 35° to 70° C. being preferred.

A grain growth step, Step (2), follows Step (1). During Step (2) the grain nuclei are grown until tabular grains having {100} major faces of a desired average equivalent circular diameter (ECD) are obtained. Whereas the objective of Step (1) is to form a grain population having the desired incorporated crystal structure irregularities, the objective of Step (2) is to deposit additional silver halide onto (grow) the existing grain population while avoiding or minimizing the formation of additional tabular grains. If additional tabular grains are formed during the growth step, the polydispersity of the emulsion is increased and, unless conditions in the reaction vessel are maintained as described above for the nucleation step, the additional tabular grain population formed in the growth step will not have the desired tabular grain properties described herein for use in the invention.

In its simplest form the process of preparing the desired emulsions can be performed as a single jet precipitation without interrupting silver ion introduction from start to finish, modified by providing a second, iodide jet for the delayed introduction of iodide—i.e., all chloride and/or bromide ions are in the dispersing medium at the outset of precipitation. As is generally recognized by those skilled in the art a spontaneous transition from grain formation to grain growth occurs even with an invariant rate of silver ion introduction, since the increasing size of the grain nuclei increases the rate at which they can accept silver and halide ion from the dispersing medium until a point is reached at which they are accepting silver and halide ions at a sufficiently rapid rate that no new grains can form. Although manipulatively simple, the modified single jet precipitation procedure limits halide content and profiles and generally results in more polydisperse grain populations. It is preferred to employ a balanced double jet precipitation technique in which silver ions and halide ions are concurrently introduced into the dispersing medium. If iodide ion is introduced using a single halide jet, the chloride in the dispersing medium can be relied upon at the outset of nucleation, so that by delaying in turning on the halide jet the appropriate delay in iodide introduction can be effected. Alternatively, a separate iodide jet can be provided.

It is specifically sought to prepare the high chloride {100} tabular grain emulsions with the most geometrically uniform grain populations attainable, since this allows a higher percentage of the total grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

Since by definition a grain must have an aspect ratio of at least 2 to be considered tabular, the average aspect ratio of the high chloride {100} tabular grains can only approach 2 as a lower limit. In fact, the tabular grain emulsions of this invention typically exhibit average aspect ratios of 5 or more, with average aspect ratios greater than 8 being preferred. That is, preferred emulsions prepared by the processes of the invention are high aspect ratio tabular grain emulsions. In specifically preferred emulsions, average aspect ratios of the tabular grain population are at least 12 and optimally at least 20. Typically the average aspect ratio of the tabular grain population ranges up to 50, but higher average aspect ratios of 100, 200 or more can be realized. Emulsions in which the average aspect ratio approaches the minimum average aspect ratio limit of 2 still provide a surface to volume ratio that is greater than 100 percent that of cubic grains.

The inventive process can be better appreciated by reference to the following examples. The term 'oxidized gelatin' is employed, except as otherwise indicated, to designate gelatin that has been treated with an oxidizing agent to reduce its methionine content to less than 30 micromoles per gram.

The following examples illustrate the practice of this invention. They are not intended to be exhaustive of all possible variations of the invention. Parts and percentages are by weight unless otherwise indicated.

EXAMPLES

Example 1

A solution containing 4369 g of distilled water, 3 g NaCl, and 195 g oxidized gelatin, is stirred and adjusted to pH=5.7 at 35° C. Nucleation of silver chloride particles is initiated by the simultaneous double jet addition of 0.5M $AgNO_3$ solution at a rate of 156 mL/min, and 0.5M NaCl solution at a rate of 167 mL/min, for 1.37 minutes.

A first solution containing 5689 g distilled water, 2.25 g NaCl, and 0.57 g KI is then added uniformly over ca. 88 seconds. The solution passes through a momentum distributor before it enters the reactor. The momentum distributor is a bundle of three tubes, each having a nominal internal diameter of ca. 7.4 mm at the discharge end. The corresponding terminal momentum each stream is ca. 1230 g cm/sec$^2$. The discharged streams travel ca. 19 cm vertically downwards through air before they impinge on the agitated surface of the dispersed medium. Next, a second solution containing 2885 g of distilled water is added and the reactor content is held at 35° C. The total duration of addition of first and second solutions, and the hold is ca. 5 min. After the hold, the mixture temperature is ramped from 35° C. to 36.5° C. in 3 minutes, and during the same time 0.5M $AgNO_3$ solution is added at 40 mL/min, with pCl ramped from 2.19 to 2.35. The pCl ramp is accomplished by the controlled addition of 0.5M NaCl. Next, the temperature is further increased from 36.5° C. to 50° C. in 18 minutes, during which period 4M $AgNO_3$ and 4M NaCl solutions are added at a constant rate of 15 mL/min, with pCl shifting from 2.35 to 2.21. The temperature is further ramped from 50° C. to 70° C. in 20 minutes, during which period the 4M $AgNO_3$ and 4M NaCl solutions are added at linearly accelerated rates of from 15 mL/min to 22.5 mL/min, with pCl linearly decreasing from 2.21 to 1.72. After the ramp, the medium is allowed to sit at 70° C. for 15 minutes. After the hold, addition of the $AgNO_3$ and NaCl solutions is resumed at linearly accelerated rates from 15 to 37.8 mL/min in 38 minutes. The pCl of the emulsion is held at 1.72 during this growth period. Then the reactor is allowed to sit at 70° C. with stirring for another 30 minutes.

The resultant emulsion is a high chloride {100} tabular grain emulsion which is 1.61 micrometers in equivalent circular diameter (ECD) and 0.13 micrometers thick, with tabular grains accounting for more than 90% of the projected area.

Example 2

The procedure in Example 1 is followed with the exception that the internal diameter of the discharge end of the momentum distributor tubes is ca. 3.4 mm. The corresponding terminal momentum of each stream is ca. 5170 g cm/sec$^2$.

The resultant emulsion is a high chloride {100} tabular grain emulsion which is 1.85 micrometers in equivalent circular diameter (ECD) and 0.13 micrometers thick, with tabular grains accounting for more than 90% of the projected area.

Example 3

The procedure in Example 1 is followed with the exception that the internal diameter of the discharge end of the momentum distributor tubes is ca. 2.4 mm. The corresponding terminal momentum of each stream is ca. 10,300 g cm/sec$^2$.

The resultant emulsion is a high chloride {100} tabular grain emulsion which is 2.29 micrometers in equivalent circular diameter (ECD) and 0.13 micrometers thick, with tabular grains accounting for more than 90% of the projected area.

Example 4

The procedure in Example 1 is followed with the exception that the internal diameter of the discharge end of the momentum distributor tubes is ca. 1.4 mm. The corresponding terminal momentum of each stream is ca. 30,300 g cm/sec$^2$.

The resultant emulsion is a high chloride {100} tabular grain emulsion which is 4.15 micrometers in equivalent circular diameter (ECD) and 0.22 micrometers thick, with tabular grains accounting for more than 90% of the projected area.

Figure 1:
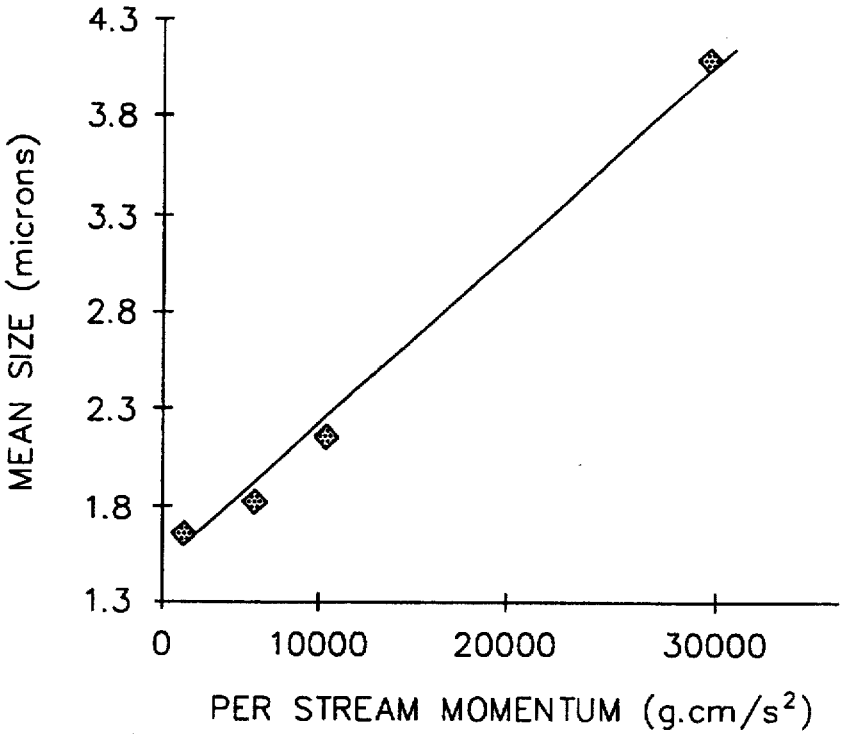
FIG. 1 is a graphical representation of the grain size variation in the examples.

The results of Examples 1–4 are summarized in FIG. 1.

Example 5

The reaction vessel used in Example 1 is expanded to a capacity of 2000 L with the relative dimensional proportions remaining unchanged. At the same time, the volume of the formula used in Example 1 is increased by a factor of 100. A tabular emulsion is prepared by procedures that otherwise are identical to those employed in Example 1. The resultant emulsion is a high chloride {100} tabular grain emulsion which is 2.0 micrometers in equivalent circular diameter (ECD) and 0.12 micrometers thick, with tabular grains accounting for more than 90% of the projected area. The number of tubes used in the momentum distribution device used for this example is 14, each having an internal diameter of ca. 19.1 mm. The corresponding terminal momentum of each stream is ca. $3.02\times10^5$ g cm/sec$^2$.

The invention has been described in detail with particular reference to preferred embodiments thereof, but it will be understood that variations and modifications can be effected within the spirit and scope of the invention.

We claim:

1. A process of producing a photographic emulsion containing a dispersing medium and grains comprised of iodide and at least 50 mole percent chloride with tabular grains having {100} major faces accounting for greater than 50 percent of total projected area, comprised of the steps of (a) separately introducing soluble silver and halide salts into a reaction vessel containing at least a portion of the dispersing medium so that nucleation occurs while the dispersing medium is maintained at a pCl in the range of from 0.5 and 3.5;

(b) during step (a) iodide ion is withheld from the reaction vessel until after the soluble silver and halide salts have reacted in the reaction vessel to form grain nuclei;

(c) during step (a) iodide ion is introduced into a momentum distribution device located above the surface of the reactor solution after at least 0.01 percent and before 3 percent of total silver forming the grains has been introduced; and solution emerging from the device in multiple streams impinges on the surface of the dispersing medium in the reactor at a momentum range between $1\times10^{-6}$ and $1\times10^{+6}$ g cm/s$^2$;

(d) following step (a) completing grain growth under conditions that maintain the {100} major faces of the tabular grains.

2. A process according to claim 1 wherein the said reactor vessel has a capacity of at least 5 liters.

3. A process according to claim 1 wherein the said reactor vessel has a capacity of at least 500 liters.

4. The process of claim 1 wherein said multiple streams have a diameter of between about 0.1 to 70 mm.

5. The process of claim 1 wherein said multiple streams are from multiple holes in a pipe.

6. The process of claim 1 wherein said multiple streams are from a planar foraminous member.

7. The process of claim 1 wherein said multiple streams comprise about 2 and 200 streams.

8. The process of claim 1 wherein said multiple streams are derived by passing said alkali iodide solution through a porous membrane.

9. A process for forming tabular silver chloride grains comprising nucleating silver chloride particles, introducing alkali iodide solution into the dispersing medium containing the nucleated silver chloride particles, and introducing silver ion and chloride ion solutions into said dispersing medium, with the proviso that introduction of the alkali iodide is by multiple streams of said alkali iodide at a momentum range of up to $1\times10^{+9}$ g cm/s$^2$.

10. The process of claim 9 wherein said momentum range is between about $1\times10^{-6}$ and $1\times10^{+9}$ g cm/s$^2$.

11. The process of claim 9 wherein said introducing alkali iodide solution into said dispersing medium comprises the introducing of multiple streams from above the surface of the dispersing medium.

12. The process of claim 11 wherein said multiple streams have a diameter of between about 0.1 to 70 mm.

13. The process of claim 9 wherein said multiple streams are from multiple holes in a pipe.

14. The process of claim 9 wherein said multiple streams are from a planar foraminous member.

15. The process of claim 9 wherein said multiple streams comprise about 2 and 200 streams.

16. The process of claim 9 wherein said multiple streams are derived by passing said alkali iodide solution through a porous membrane.

17. The process of claim 9 wherein said nucleation occurs while the dispersing medium is maintained at a pCl of from 0.5 to 3.5.

18. The process according to claim 9 wherein said dispersing medium is in a reactor vessel has a capacity of at least 500 liters.

19. The process of claim 9 wherein said dispersing medium is in a reactor vessel of at least 5 liters.

20. The process of claim 9 wherein said introducing alkali iodide solution into the dispersing medium, is after at least 0.01 percent and before 3 percent of the total silver in forming the grains has been introduced.

* * * * *